United States Patent [19]

Saunders

[11] 4,380,226

[45] Apr. 19, 1983

[54] WINGED ARROW REST

[75] Inventor: Charles A. Saunders, Columbus, Nebr.

[73] Assignee: Saunders Archery Company, Columbus, Nebr.

[21] Appl. No.: 268,629

[22] Filed: May 29, 1981

[51] Int. Cl.[3] ..... F41B 5/00

[52] U.S. Cl. ..... 124/41 A

[58] Field of Search ..... 124/41 A; 24 A, 88

[56] References Cited

U.S. PATENT DOCUMENTS

| | | | |
|---|---|---|---|
| 3,292,607 | 12/1966 | Hoyt | 124/41 A |
| 3,672,347 | 6/1972 | Allen | 124/41 A |
| 4,064,863 | 12/1977 | Helmick | 124/41 A |

*Primary Examiner*—Richard C. Pinkham

*Assistant Examiner*—William R. Browne

*Attorney, Agent, or Firm*—Michael G. Berkman

[57] ABSTRACT

An arrow rest for securement to an archery bow. A hingedly-supported wing having a low-friction top edge for supporting an arrow shaft riding thereon is yieldingly and resiliently pivotal about a forwardly and upwardly projecting hinge-line in response to frictional forces applied by an arrow shaft riding forwardly along a bearing top edge of the wing, pivotal forward movement of the wing about its hinge effecting a downward displacement of the arrow-shaft-supporting edge of the wing as the arrow shaft rides thereon, thereby reducing frictional drag on the arrow shaft riding on the wing. The wing extends outwardly and rearwardly from a panel which supports the wing.

8 Claims, 6 Drawing Figures

WINGED ARROW REST

BACKGROUND OF THE INVENTION

The present invention relates to an attachment for securement to an archery bow. More particularly, the invention is directed to an improved arrow rest which supports the shaft of an arrow prior to and during its propulsion from the bow.

Many different types of arrow rest devices have been used both by target archers and by hunters. Irrespective of the particular application involved, the purpose of the rest is to promote true flight and to reduce the undesirable deflection effects caused as an arrow feathers past the bow. The prior art devices have taken various forms and have been constructed of various types of materials. Some of the structures are adapted for securement to the shelf of the bow window while others are attached to the sidewall of the window itself. Some have "adjustment" features or capabilities, while others are of a fixed physical construction. Many of the available rests are unduly complex and are difficult to mount on the bow and to use. Others have proven ineffective for their intended purpose, causing undesirable arrow deflection and impairing overall accuracy. Notwithstanding the considerable research and developmental work that has been directed to this particular feature of archery, no generally accepted or completely satisfactory rest has heretofore been produced.

It is, therefore, the aim of the present invention to provide a simple, yet highly effective arrow rest which avoids many of the above-described objectional features and disadvantages and which has widespread application both for target use and for hunting.

SUMMARY OF THE INVENTION

It is a principal object of the invention to provide an arrow rest which is simply and readily attachable to an archery bow.

A related object of the invention is to provide an arrow rest which is positionable, at selectable locations, to accommodate the unique requirements of each particular bow.

Yet another feature of the invention is that the arrow rest is fabricated of structural materials which are highly resistant to the adverse effects of climate and exposure.

A related feature of the invention is that the arrow rest is simple in construction and is adapted to provide a long useful life.

A significant advantage of the arrow rest of the invention is that it materially reduces the frictional forces between the arrowshaft and the bow during expulsion of the shaft from the bow in flight.

A related feature of the invention is that it includes the physical capability of responding to frictional forces applied thereto so as to reduce those frictional forces.

A specific feature of the arrow rest is that it may be glued or adhesively secured to the side of the window of the bow, at any preferred vertical position.

A significant advantage of the arrow rest is the slope of the wing which helps hold the arrow securely against the bow during the act of shooting, yet swings downward as it moves forward, therefore not affecting the natural flight of the arrow.

Another important advantage of the arrow rest of the invention is its versatility in use, being attachable to bows both with and without shelf elements in the window sections.

An important structural feature of the improved arrow rest of the invention is that, while it has "moving" components, it completely avoids the use of metal elements or other materials which might be subject to corrosion or deterioration.

A specific feature of the arrow rest of the invention is a laterally extending pivotal wing which includes an upper edge constituting a bearing surface along which the arrow shaft glides upon its expulsion from the bow.

A related feature of the arrow rest is that the pivotal wing upon which the arrow shaft rests, moves forwardly and downwardly upon release of the arrow from the bow, thereby acting significantly to reduce the frictional contact between the arrow shaft and the arrow rest upon expulsion of the arrow from the bow.

An auxiliary mechanical feature of the arrow rest is the provision of a mechanical stop which arrests or limits rearward movement of the pivotal wing and ensures its proper positioning and orientation at the initiation of each shot.

It is an important unique feature of the present invention that the very frictional forces between the arrow shaft and the arrow rest which normally tend to interfer with the ideal release characteristics of an arrow shaft from the bow act upon the arrow rest itself to reduce substantially the friction between the arrow shaft and the arrow rest.

Other and further objects, features, and advantages of the invention will become apparent from a reading of the following specification taken in conjunction with the drawing.

DETAILED DESCRIPTION OF PREFERRED EMBODIMENT

The aims and objects of the invention are realized by providing an arrow rest which consists essentially of a pivotal and retractable wing secured to the sidewall of the window of the bow by any suitable means or technique but which is preferably bonded by a pressure sensitive adhesive applied as a coating to a panel which carries the wing, the panel being fastened to the sidewall of the bow window.

The arrow-shaft-supporting pivotal and retractable wing moves forwardly and downwardly upon the application of frictional forces against its upper, shaft-supporting edge. The downward displacement of the bearing edge serves effectively to withdraw the edge from engagement with the arrow shaft thereby reducing the frictional forces between the arrow rest and the arrow shaft upon release and propulsion of the shaft, in flight, from the bow. The trajectory of the arrow is thus improved, promoting true flight. After release and discharge of the arrow from the bow, the pivotal wing automatically swings back to return to its initial, standby position. A spur or mechanical stop element secured to and constituting a part of the arrow rest ensures proper initial spatial orientation of the wing of the arrow rest with respect to the bow itself.

Figure 2:
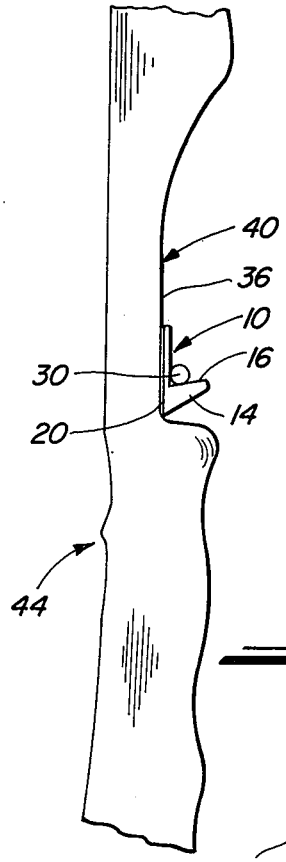
FIG. 2 is a front elevational view as seen from the side of the bow away from the string.
Figure 1:
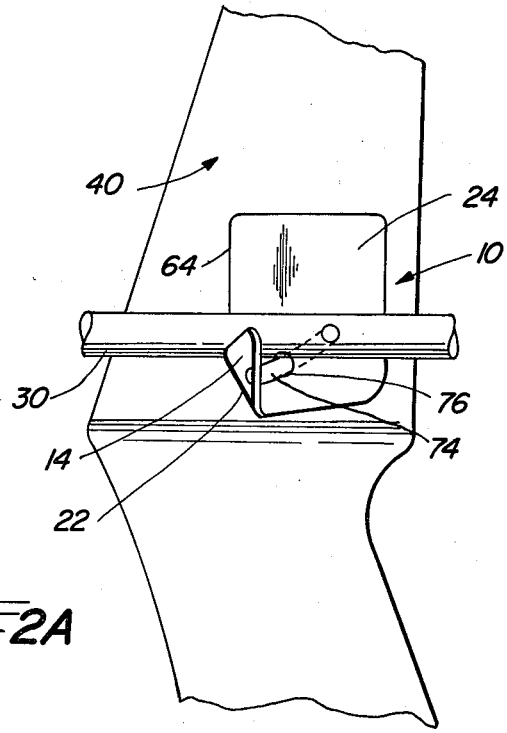
FIG. 1 is a fragmentary side elevational view of a bow structure with an arrow rest embodying the features of the invention, the arrow rest being mounted on the bow and supporting the shaft of an arrow.
Figure 2A:
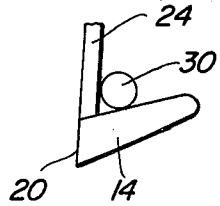
FIG. 2A is an enlargement of a detail of FIG. 2, showing an arrow shaft supported on the arrow rest.
Figure 4:
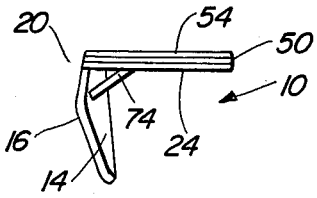
FIG. 4 is a top view of the arrow rest.
Figure 3:
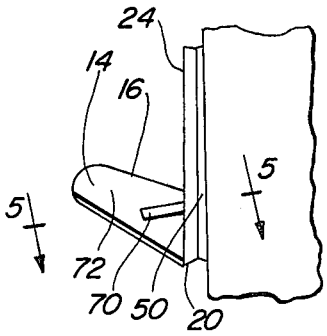
FIG. 3 is a rear elevational view of the arrow rest of invention, fastened to a bow.
Figure 5:
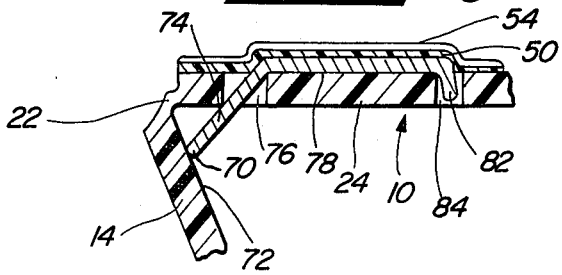
FIG. 5 is a cross-sectional view taken substantially on the lines 5—5 of FIG. 3.

Referring now more particularly to the drawing, and especially to FIGS. 1, 4 and 5, for purposes of disclosure, one preferred embodiment of the arrow rest 10 of the invention is shown as comprising a tab or wing 14 preferably fabricated of a high lubric sheet material such as polytetrafluoroethylene (Teflon) or polytrifluorochloroethylene (Kel-F). The wing 14 is integrally joined along a hinge-line 20 to a mounting panel 24, which is preferably of the same plastic sheet composition as is the wing 14. In the preferred embodiment of the invention shown, the hinge-line 20 defines a live hinge 22 constituting a juncture between the wing 14 and the panel 24, but of a reduced through thickness as indicated schematically in the cross-sectional representation of FIG. 5. The resulting physical structural arrangement has been identified as a "live" hinge. In the physical disposition of the arrow rest of the invention, the initial orientation or the bias of the wing is such that the wing element 14 extends outwardly from the panel 24 and generally normally thereto.

As shown (FIG. 1), the wing 14 is attached to the support panel 24 at a forward limit thereof. An important and critical feature of the arrow rest of the invention is the angle of the hinge-line 22 by which the wing 14 is fastened to the panel 24. Specifically, the hinge-line projects upwardly and forwardly from a base of the juncture of the wing 14 with the panel 24. That is, the hinge line is not parallel to the bow string. As a result of this unique and important structural arrangement, as the wing swings or pivots forwardly on the hinge 22, in response to frictional forces of the arrow shaft 30 riding and sliding therealong, the top, arrow-supporting edge 16 of the wing 14 is displaced downwardly from or retracts from its initial, arrow-supporting position. A practical, important and novel effect of the structure described is to reduce the frictional engagement between the arrow shaft 30 and the shaft-supporting edge 16 of the wing 14 of the arrow rest 10 as the arrow is released on its trajectory or flight.

In the preferred embodiment of the invention shown, the arrow rest support or securement panel 24 is fastened to the inside face 36 of the bow window 40 of the bow 44 at a selectable location at the rigid mid-section of the bow and within the viewing window. While any suitable means may be used for attachment of the panel 24 to the sidewall 36 of the bow window 46, in the preferred embodiment of the arrow rest shown, the panel 24 is coated with a layer or sheet of pressure-sensitive adhesive 50. Prior to attachment of the arrow rest 10 to the bow 44, the adhesive layer 50 is protected by a peelable cover sheet 54, in accordance with established techniques of the relevant art.

In the forming of the live hinge 22 at the juncture between the wing 14 and the support panel 24, the thinning and the orientation during fabrication are so carried out as to bias the wing 14 to project or to extend generally outwardly from and somewhat rearwardly with respect to a forward vertical edge or limit 64 of the mounting panel 24. In order to ensure proper orientation of the wing 14 at the time the arrow shaft 30 is positioned on the arrow rest 19, in a preferred embodiment of the invention there is provided a spur or mechanical stop 70. The stop 70 engages or abuts the near or rearward face 72 of the wing 14, in its "standby" disposition. While any preferred technique may be used for securing the stop 70 in place, in the preferred embodiment of the invention shown (FIG. 5), the stop 70 constitutes the end of a rigid wire, rod or bar 74. The bar 74 is threaded through a cooperating opening 76 formed in the support panel 24 and is secured to the rear face 78 of the bow sight mounting panel 24. In order to stabilize the assembly, to prevent undesirable shifting or movement of the stop 70, the opposite end 82 of the bar 74 is bent inwardly to seat in a cooperating opening 84 in the panel 24 so that the bar 74 is effectively keyed against displacement or shifting.

While the invention has been described with reference to a preferred embodiment, it will be readily appreciated that various changes and modifications may be made, based on the teachings herein. It is intended to cover through the present application all such modifications which fall within the true spirit and scope of the appended claims.

What is claimed is:

1. An arrow rest for use in an archery bow having a rigid mid-section including a sidewall, said arrow rest comprising substantially planar vertically extending panel means for attachably securing said arrow rest to the bow, bonding means for fastening said panel means continguously to the bow on a sidewall thereof, winged means for supporting an arrow shaft resting thereon, said winged means having a top bearing edge for supporting an arrow shaft thereon, said edge projecting laterally outwardly and rearwardly from said panel means, hinge means pivotally and resiliently securing said wing means to said panel means at a generally vertically extending juncture of said wing means with said panel, said hinge means defining a hinge line angled upwardly and forwardly from a base of the juncture of said winged means with said panel means, said bearing edge of said winged means adapted to support the arrow shaft of an arrow riding thereon and stressing downwardly thereagainst, weight and frictional forces applied to said winged means by an arrow shaft riding forwardly therealong on said bearing edge thereof causing said winged means to pivot yieldingly and resiliently forwardly on said hinge means, pivotal forward movement of said winged means about said upwardly and forwardly projecting hinge line of said hinge means, due to frictional drag of an arrow being projected, effecting a simultaneous downward displacement of said arrow-shaft-supporting bearing edge of said winged means away from a general center line of an in-place arrow to reduce frictional drag against an arrow shaft riding on said bearing edge and facilitating and promoting true flight of the arrow upon propulsion thereof from the bow.

2. The structure as set forth in claim 1 and further comprising stop means to limit pivotal displacement of said wing means toward said panel means.

3. The structure as set forth in claim 2 wherein said stop means for limiting pivotal displacement of said wing means toward said panel means comprises spur means, and means securing said spur means to said panel means to project therefrom toward said wing means.

4. The structure as set forth in claim 3 wherein said spur means comprises a mechanical strut extending outwardly from said panel means and toward said wing means for abutment therewith.

5. The structure as set forth in claim 1 wherein said hinge means comprises a live hinge of plastic sheet material defined by a thinned juncture of said panel means with said wing means.

6. The structure as set forth in claim 1 wherein said panel means and said wing means comprise a low-friction, lubric plastic sheet material, and wherein said panel means and said wing means constitute a unitary assembly joined along a live hinge integrally formed with said panel means and said wing means.

7. The structure as set forth in claim 1 wherein said means for fastening said panel means to a side wall of the bow comprises a pressure-sensitive adhesive disposed on a bow-presented surface of said panel means.

8. The structure as set forth in claim 1 wherein said top bearing edge of said wing is angled upwardly as viewed from said panel means.

* * * * *